US005966958A

United States Patent [19]

Maynard

[11] Patent Number: 5,966,958

[45] Date of Patent: Oct. 19, 1999

[54] CONDENSATE TRAY IN A REFRIGERATION ASSEMBLY

[75] Inventor: James Maynard, Alpharetta, Ga.

[73] Assignee: Habco Beverage Systems Inc., North York, Canada

[21] Appl. No.: 09/118,369

[22] Filed: Jul. 17, 1998

[51] Int. Cl.[6] ..... F25B 47/00

[52] U.S. Cl. ..... 62/277; 62/279; 62/285

[58] Field of Search ..... 62/277, 279, 285

[56] References Cited

U.S. PATENT DOCUMENTS

| | | | |
|---|---|---|---|
| 2,644,319 | 7/1953 | Millman | 62/103 |
| 2,721,451 | 10/1955 | Schumacher | 62/103 |
| 3,077,084 | 2/1963 | Kanter | 62/278 |
| 4,497,183 | 2/1985 | Gelbard | 62/295 |
| 5,678,421 | 10/1997 | Maynard | 62/407 |

*Primary Examiner*—Henry Bennett
*Assistant Examiner*—Melvin Jones

[57] ABSTRACT

The invention provides a condensate tray for a condenser assembly of a refrigeration assembly and a condenser assembly having the condensate tray. The condensate tray includes an operatively upper liner associated with an operatively lower tray bottom. The liner and bottom are spaced from each other to accommodate a coolant coil disposed therebetween in a predetermined path. At least one locating groove is provided in either of the upper liner and the lower bottom for locating the coolant coil in the predetermined path. The condensate tray minimizes vibration in the coil which may lead to rupture thereof. Also, the tray is easy to clean and shields the coil from condensate which may cause corrosion thereof.

17 Claims, 7 Drawing Sheets

CONDENSATE TRAY IN A REFRIGERATION ASSEMBLY

FIELD OF THE INVENTION

The invention relates to the field of refrigeration and, more particularly, to a condensate tray of a condenser assembly of a refrigeration assembly.

BACKGROUND OF THE INVENTION

Refrigeration systems are used in various industries, including the food industry, domestically and commercially for storing and maintaining products, such as food and beverages, at a low temperature.

These systems include a storage compartment for the products and a refrigeration assembly for cooling the air and products in the storage compartment.

The refrigeration assembly includes an evaporator assembly and a condenser assembly arranged in a closed circuit so that coolant may be cycled through the refrigeration assembly. Coolant absorbs heat from the storage compartment when in the evaporator assembly thereby cooling the storage compartment contents. The coolant is cooled in the condenser assembly, whereupon the coolant is returned to the evaporator assembly to again absorb heat from the storage compartment.

When in the condenser assembly, coolant is carried through a compressor which compresses the coolant. The compressed coolant is then carried to a heat exchanging condenser through a coil which, in part, is laid in a serpentine path in a condensate tray. The condensate tray is normally located below the heat exchanging condenser for collecting moisture or condensate drained from the evaporator assembly and the heat exchanging condenser. Locating the coil in the tray conveniently allows hot coolant emerging from the compressor to heat and evaporate any moisture present in the tray. Evaporated moisture exits the refrigeration system with the assistance of a fan contained in the heat exchanging condenser.

In prior art condenser assemblies known to the applicant, the coil is located in the tray by brackets in the tray. Also, the coil vibrates by virtue of the flow of compressed coolant through the coil. The brackets used to locate the coil in the condensate tray do little if anything to temper the vibration. As a result of the vibration, the coil may rupture through contact with surrounding components, causing coolant to be lost and the refrigeration assembly to shut down.

Vibration of the coil is exacerbated in condenser assemblies in which the condensate tray is proximate to the compressor. An example of a prior art condenser assembly in which this is the case is disclosed in U.S. Pat. No. 5,678,421 to Maynard et al. A structure for alleviating the deleterious effect of coil vibration is taught in this patent. In this structure, the coil is located in the condensate tray by brackets which are fastened to risers integrally formed in the condensate tray. The coil is thereby spaced from the tray and contact between the two is minimized when the coil vibrates which minimizes the likelihood of coil rupture. There is however still a need for a new arrangement of a coil in a condensate tray which also alleviates the problem of coil rupture through vibration of the coil and other problems in the art as follows.

The coolant coil, being located in the condensate tray, is exposed to moisture in the tray. Consequently, there is the problem of corrosion of the coolant coil. In refrigeration systems in which the storage compartment is disposed above the refrigeration assembly, spilled liquid products stored in the storage compartment may leak into the condensate tray further contributing to corrosion of the coolant coil.

A further problem associated with prior art condensate tray arrangements is that they are often difficult to clean. The coil and tray must be disassembled to thoroughly clean the tray of liquid residues and other substances.

An object of the invention is to provide an improved condensate tray arrangement which will address the above-mentioned problems.

SUMMARY OF THE INVENTION

In accordance with this invention, there is provided a condensate tray for a condenser assembly of a refrigeration assembly, the condensate tray including an operatively upper liner associated with an operatively lower tray bottom. The liner and bottom are spaced from each other to accommodate a coolant coil disposed therebetween in a predetermined path. At least one locating groove is provided in either of the upper liner and the lower bottom for locating the coolant coil in the predetermined path.

In accordance with another aspect of the invention, there is provided a condenser assembly of a refrigeration assembly including a condensate tray according to the invention.

BRIEF DESCRIPTION OF THE DRAWINGS

Embodiments of the invention will now be described with reference to the drawings in which.

DETAILED DESCRIPTION OF THE PREFERRED EMBODIMENTS

Figure 1:
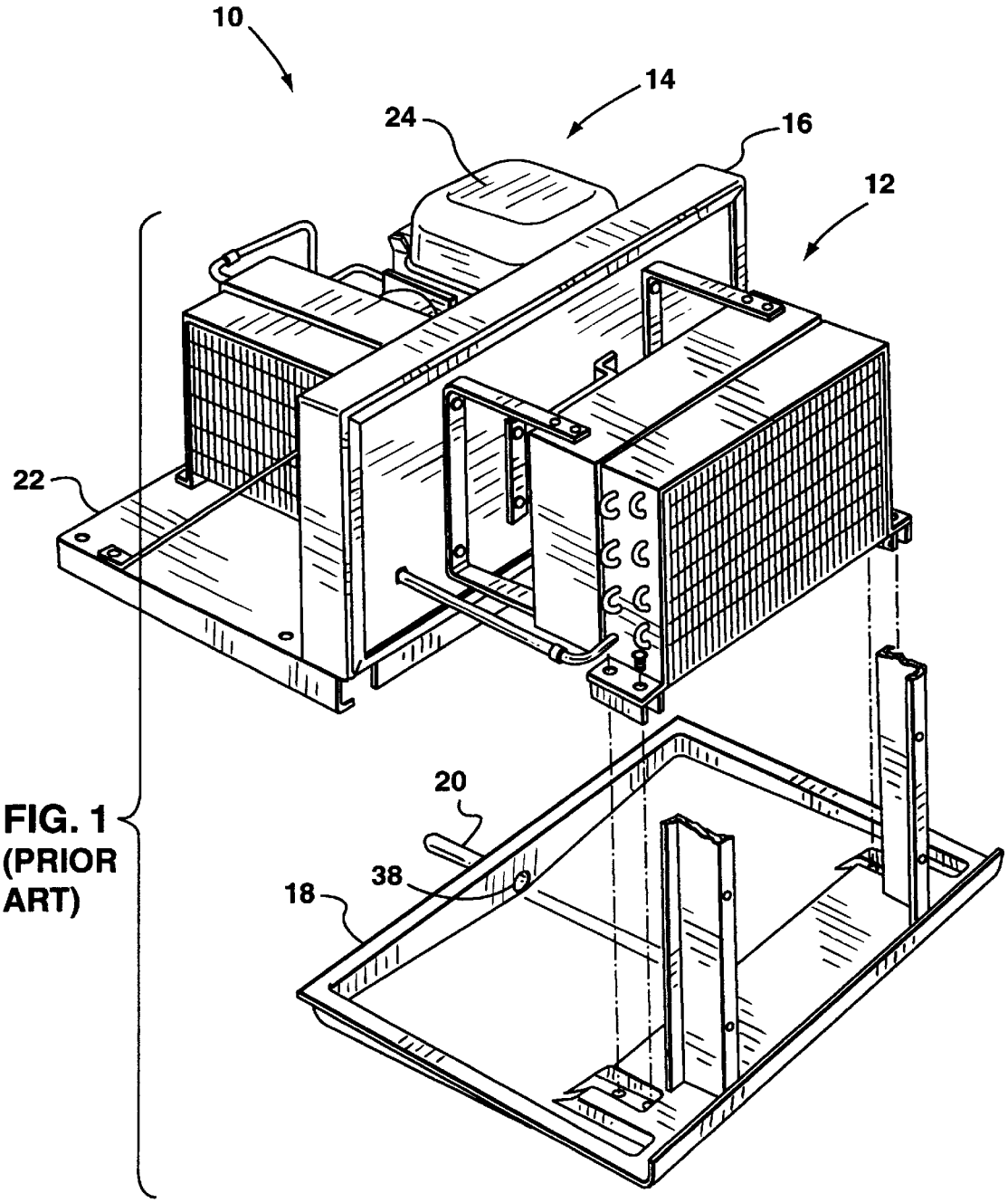
FIG. 1 (PRIOR ART)
FIG. 1 is an assembly drawing of a refrigeration assembly including a condenser assembly and an evaporator assembly.
Figure 2:
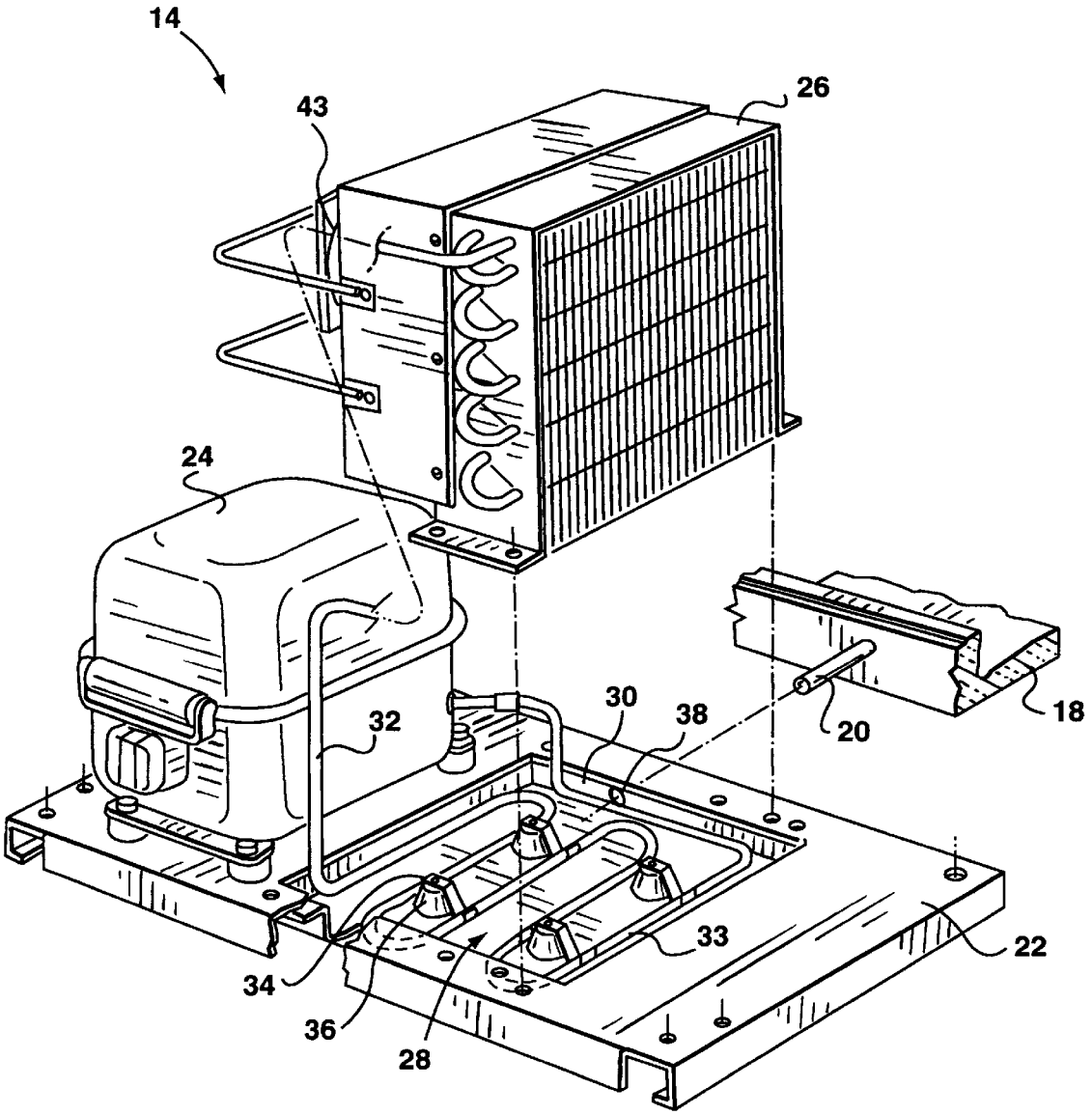
FIG. 2 (PRIOR ART)
FIG. 2 is an assembly drawing of part of the refrigeration assembly of FIG. 1 showing the condenser assembly incorporating a condensate tray in accordance with the prior art.
Figure 3:
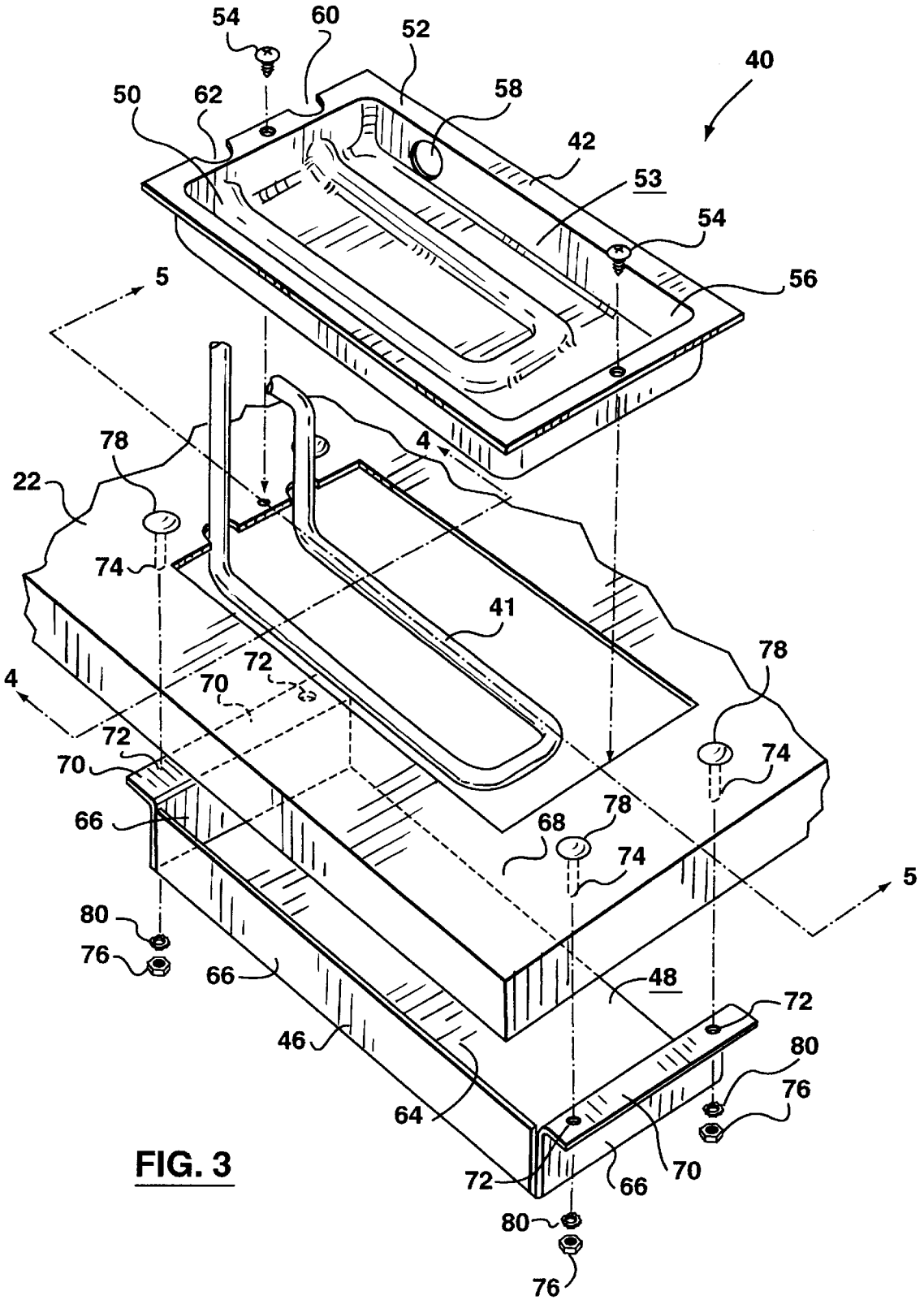
FIG. 3 is an assembly drawing showing a preferred embodiment of a condensate tray in accordance with the invention.

A prior art refrigeration assembly, designated generally by reference numeral 10, is shown in FIGS. 1 and 2. The refrigeration assembly 10 includes an evaporator assembly and condenser assembly, designated generally by reference numerals 12 and 14, respectively, disposed on either side of a bulkhead 16.

Coolant is circulated in a closed circuit between the evaporator assembly 12 and the condenser assembly 14. The refrigeration assembly 10 further includes an evaporator pan 18 disposed below the evaporator assembly 12 for collecting condensed moisture from the evaporator assembly 12. The condensed moisture is conveyed to a condensate tray of the condenser assembly 14 through a conduit in the form of drain pipe 20, as will be described further below.

Referring to FIG. 2, the condenser assembly 14 includes a condenser support 22 supporting a compressor 24 and a heat exchanging condenser 26 disposed adjacent to the compressor 24. The condenser support 22 has an opening 28 below which a prior art condensate tray 30 is secured to the support 22 by screws (not shown) and extends the full area of the opening 28 and underneath the heat exchanging condenser 26.

Hot, fully or partly vaporized, coolant emerging from the evaporator assembly (FIG. 1) is circulated to the compressor 24 where it is compressed. The compressed coolant is carried through a copper coolant coil 32 to the heat exchanging condenser 26 where it is cooled. A portion 33 of the coolant coil 32 is laid in the condensate tray 30 in a serpentine path. The portion 33 is supported on brackets 34 affixed to risers 36 integrally formed with the tray 30. Condensed moisture from the evaporator pan 18 is delivered through drain pipe 20 to the condensate tray 30 through an aperture 38 in the tray 30. Moisture condensed from the heat exchanging condenser 26 also drains into the condensate tray 30. Where the refrigeration assembly is mounted in a refrigeration system below a storage compartment of the refrigeration system for storing liquids, such as beverages, spilled liquid may also flow onto the condensate tray 30. Thus, the portion 33 of the coolant coil 32 is often in contact with liquid collected in the tray, which liquid contributes to corrosion of the coil 32. This arrangement is also susceptible to the other aforedescribed problems, namely, rupturing of the coil 32 due to vibration thereof caused by the flow of compressed coolant therethrough. Also, the condensate tray 30 and coil 32 must be disassembled in order that the tray may be cleaned.

The description, thus far, is of a prior art refrigeration assembly. A condensate tray, designated generally by reference numeral 40, according to a first preferred embodiment of the invention will now be described. The condensate tray 40 is mountable to the prior art condenser support 22. The tray 40 has an operatively upper stainless steel liner 42 having a lower coil-facing surface 44 (FIG. 4), and an operatively lower galvanized stainless steel tray bottom 46 formed by sheet metal fabrication disposed below and spaced from the liner 42 and having an upper coil-facing surface 48. A continuous groove 50 is formed in the lower surface 44 of the liner 42 by stamping and locates a portion of a coolant coil 41 in a predetermined path between the liner 42 and tray bottom 46.

Figure 4:
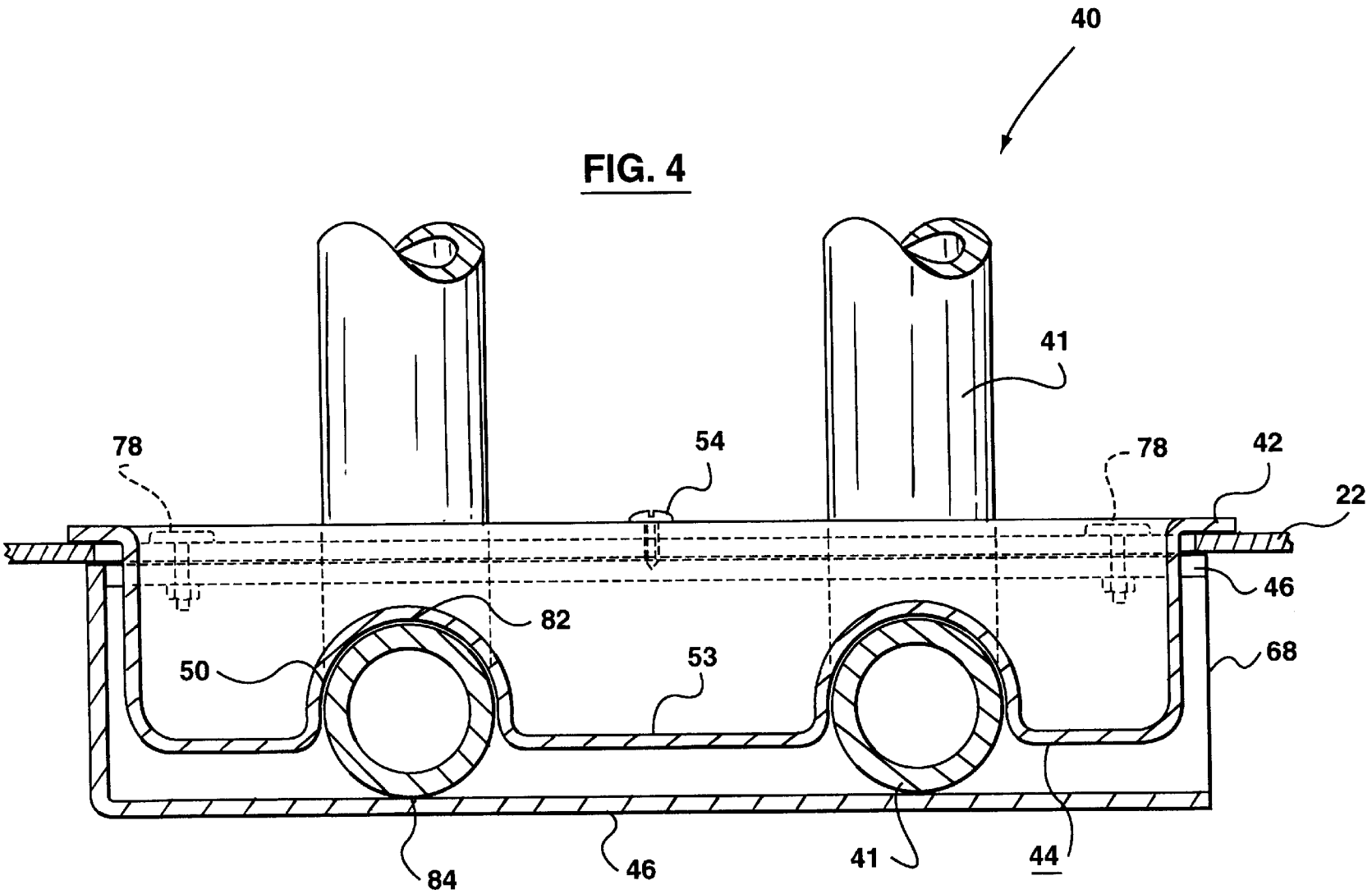
FIG. 4 is a partial sectional view drawn generally on line 4—4 of FIG. 3, with the condensate tray in an assembled configuration.
Figure 5:
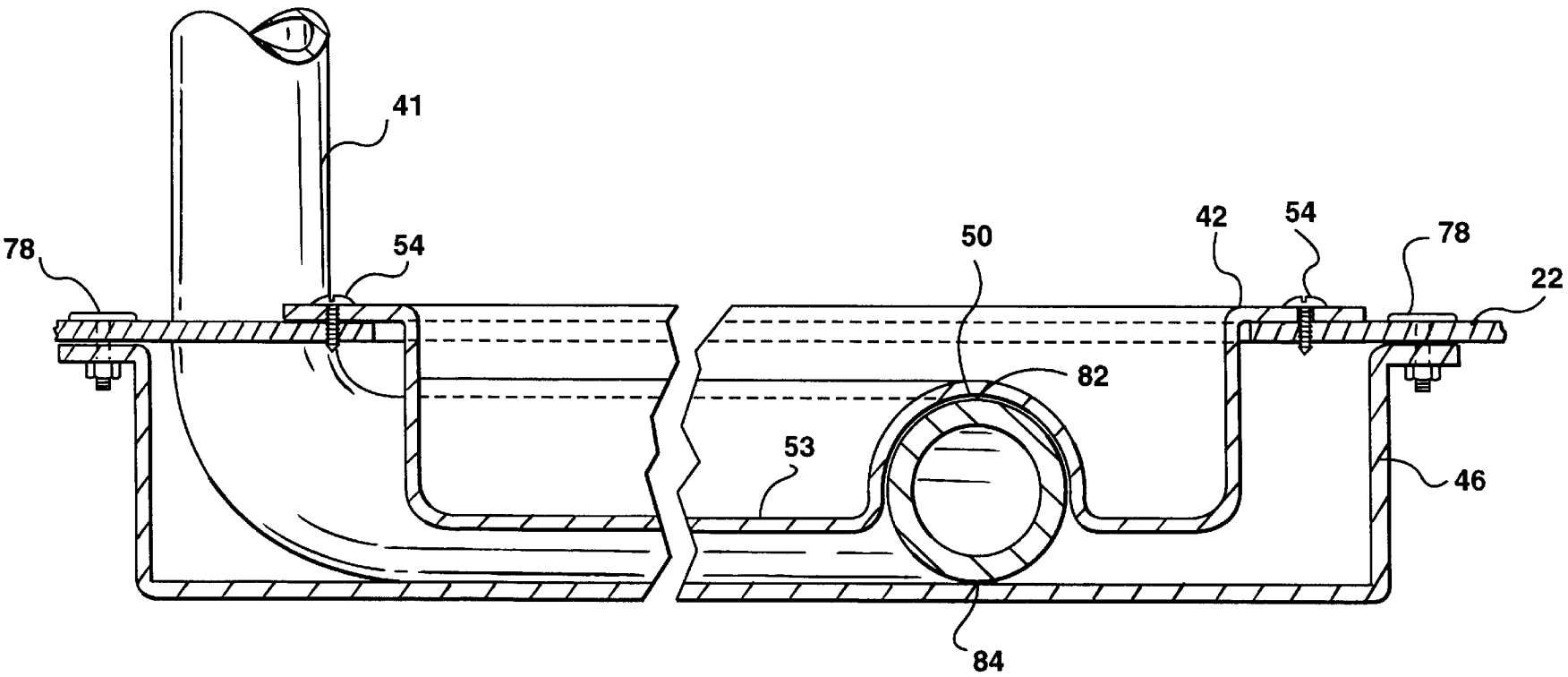
FIG. 5 is a partial sectional view drawn generally on line 5—5 of FIG. 3, with the condensate tray in an assembled configuration.

The liner 42 includes an integral horizontally extending flange 52. The flange 52 and the condenser support 22 are apertured to receive securing fasteners in the form of screws 54 for securing the liner 42 to the condenser support 22 with a lower surface of the flange lying flush against an upper surface of the condenser support 22 (as can be seen in FIGS. 4 and 5).

The liner 42 is recessed on an upper surface 53 thereof with a main portion 56 extending below the flange 52 so that the liner is adapted to retain liquid on the liner. The liner 42 also has a hole 58 to receive the drain pipe 20 through which moisture from the evaporator assembly 12 is conveyed to the upper surface 53. Further, the flange 52 is cut to provide respective entry and exit openings 60, 62 for the coil 41.

The tray bottom 46 includes a rectangular planar bottom wall 64 and three upstanding side walls 66 integrally formed with and extending upwardly from respective three of four edges of the bottom wall 64 so that the tray bottom 46 is open at one side 68 thereof.

The tray bottom 46 has a pair of opposed horizontally extending flanges 70 integrally formed with upper edges of opposed sides 66. The flanges 70 are each provided with a pair of apertures 72 for registering with corresponding apertures 74 of the condenser support 22. When so registered, securing fasteners in the form of nuts 76, bolts 78, and washers 80 are used to secure the tray bottom 46 to the condenser support 22 with a top surface of the flanges 70 lying flush against a bottom surface of the support 22 (FIGS. 4 and 5).

FIGS. 4 and 5 show the condensate tray 40 secured to the condenser support 22. When secured, the liner 42 and tray bottom 46 are disposed above and below the condenser support 22, respectively, with the coolant coil 41 disposed between the liner and tray bottom 42, 46 and in the groove 50. Upper and lower surfaces 82, 84 of the coolant coil 41 are in engagement with the liner and tray bottom respectively so that vertical motion of the coolant coil 41 is greatly restricted. Lateral or horizontal movement of the coil is likewise greatly restricted by the groove 50. Consequently, vibration of the coolant coil 41 caused by the flow of compressed coolant through the coil is greatly minimized and localized stresses on the coolant coil are greatly reduced.

The condensate tray 40 is mountable on the prior art refrigeration assembly 10 with the open side 68 (FIG. 4) of the bottom 46 closed by a bulkhead (not shown) of the refrigeration assembly. Consequently ambient air does not find its way into the space within the walls 66 and bulkhead of the bottom 46 and around the portion of the coil 41 disposed in the bottom 46. The lack of air circulation serves to maintain the coil 41 at a high temperature in the tray 40 prior to entering the heat exchanging condenser 26. The heat from the high temperature coil is transmitted through the stainless steel liner 42 and evaporates liquid collected on the liner 42. A fan 43 in the heat exchanging condenser 26 blows the air containing vaporized liquid away from the refrigeration assembly 10 to the external environment.

The condensate tray 40 thus described has the advantage of shielding the coolant coil 41 from liquid which may cause corrosion of the coolant coil 41. In this arrangement, liquid is collected on the recessed upper surface 53 of the liner and does not come in contact with the coil 41. The liner 42 of the condensate tray 40 is also easily cleaned without disturbing the coil 41. The liner may be cleaned of liquid residue or other substances collected on the liner by wiping the upper surface 53 with a damp cloth or other suitable material.

While the preferred embodiment of the condensate tray 40 has been described as having a liner 42 made of stamped stainless steel, it will be appreciated that the liner 42 may be formed by any suitable means and made of any suitable material such as vacuum formed thermoplastic.

The tray bottom 46 may also be made of any suitable material, such as aluminum, and by any suitable means such as by stamping.

Figure 6:
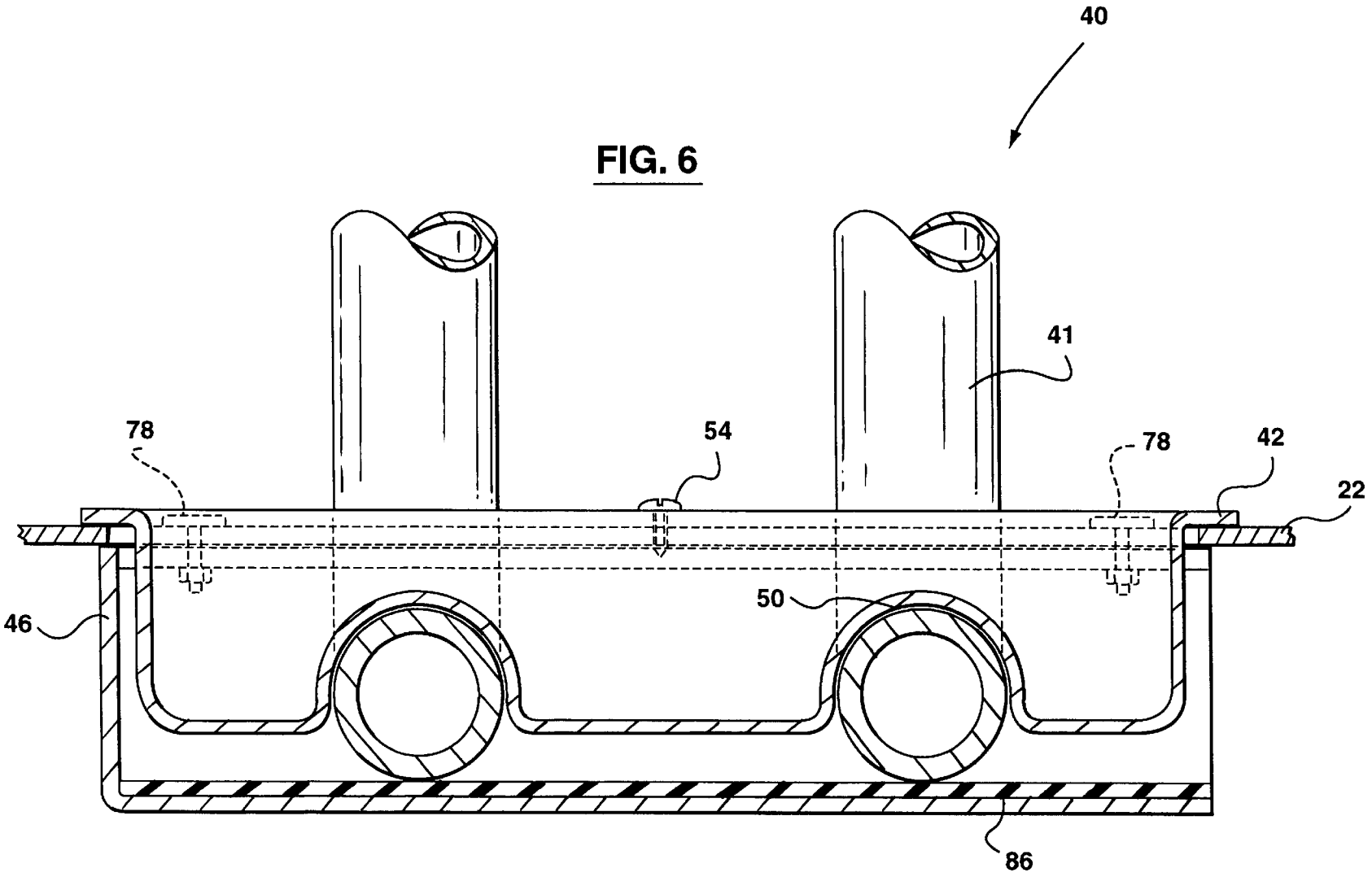
FIG. 6 is a view similar to the view of FIG. 4 showing an alternative embodiment of the invention.
Figure 7:
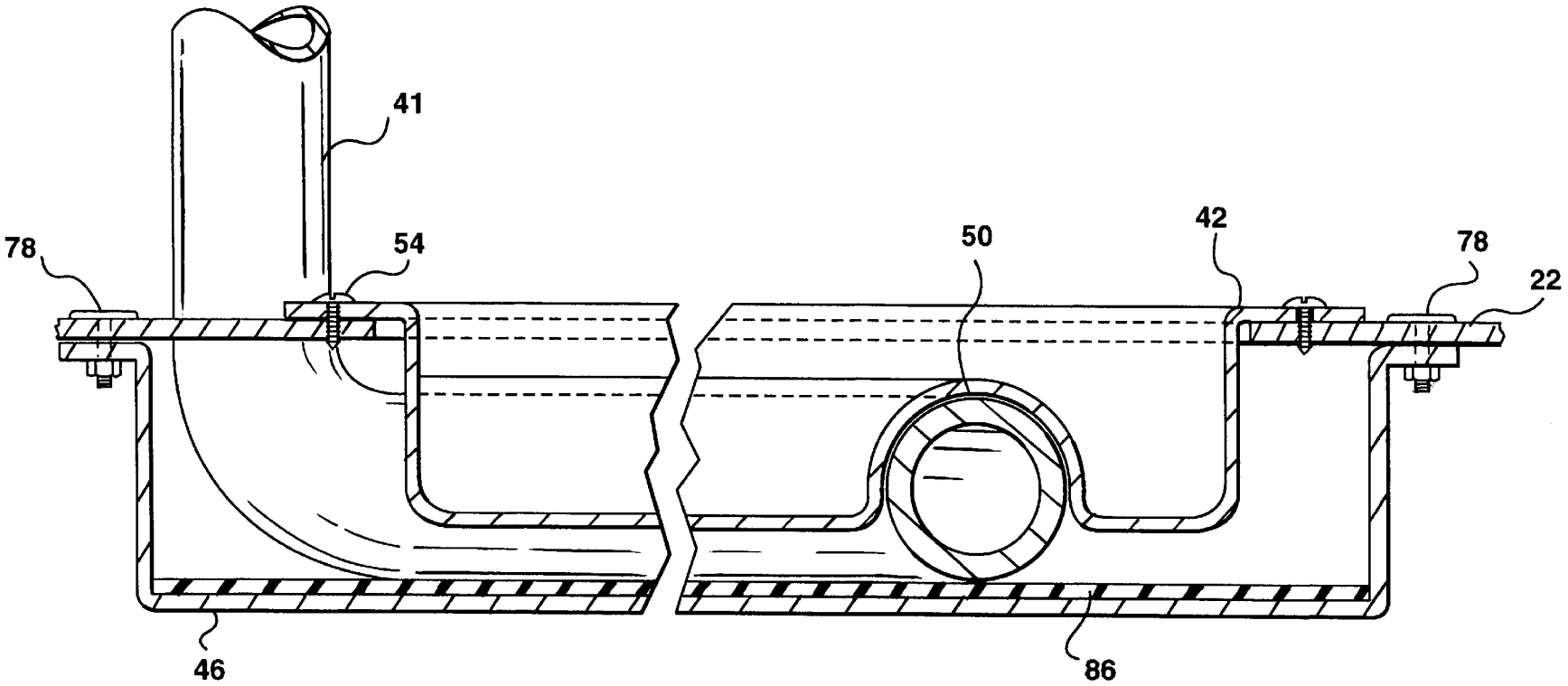
FIG. 7 is a view similar to the view of FIG. 5 showing the alternative embodiment of the invention of FIG. 6.

Referring to FIGS. 6 and 7, the condensate tray 40 may include an insulating and shock-absorbing layer, such as a 3/32 inch rubber layer 86 disposed between the coolant coil 41 and the tray bottom 46. The rubber layer 86 functions to further reduce the stresses on the coolant coil 41 caused by vibration thereof thereby reducing the likelihood of rupture. The layer 86 may range in thickness from between 1/16 to 1/8 inches and be made of any suitable material, such as a synthetic plastic with a reflective aluminum layer.

The foregoing description is by way of example only and is not meant to limit the scope of the invention as defined by the appended claims.

I claim:

1. A condensate tray for a condenser assembly of a refrigeration assembly, the tray comprising, an operatively upper liner having a lower coil-facing surface;

an operatively lower tray bottom disposed below and spaced from the liner and having an upper coil-facing surface;

at least one groove provided in at least one of the coil-facing surfaces for locating a coolant coil in a predetermined path between the liner and tray bottom; and means for coupling the liner and bottom to a fixed portion of the condenser assembly.

2. Condensate tray according to claim 1 in which said at least one groove is one continuous groove in the coil-facing surface of the liner.

3. Condensate tray according to claim 2 in which the liner is made from stainless steel and said groove is formed by stamping.

4. Condensate tray according to claim 1 in which the liner is recessed on an upper surface thereof to retain liquid thereon, the liner further being apertured to receive a conduit through which moisture from an evaporator assembly is conveyed to the upper surface of the liner.

5. Condensate tray according to claim 1 in which the liner has a peripheral horizontally-extending flange apertured to receive securing fasteners.

6. Condensate tray according to claim 1 in which the liner has a peripheral horizontally-extending flange with respective entry and exit openings for a coolant coil.

7. Condensate tray according to claim 1 in which the tray bottom has at least two horizontally-extending flanges apertured to receive securing fasteners.

8. Condensate tray according to claim 1 in which the tray bottom is made from sheet metal.

9. A condenser assembly of a refrigeration assembly comprising, a condenser support having an opening formed therein;

a compressor supported by the condenser support;

a heat exchanging condenser supported by the condenser support and disposed adjacent to the compressor;

a condensate tray disposed at the opening of the condenser support and comprising, an operatively upper liner having a lower coil-facing surface;

an operatively lower tray bottom disposed below and spaced from the liner and having an upper coil-facing surface;

at least one groove provided in at least one of the coil-facing surfaces;

a coolant coil for carrying coolant from the compressor to the heat exchanging condenser, the coolant coil being located by the at least one groove in a predetermined path between the liner and the tray bottom; and coupling means for securing the liner and the tray bottom to the condenser support.

10. A condenser assembly according to claim 9 in which the liner is made from stainless steel and the groove is formed by stamping.

11. A condenser assembly according to claim 9 in which the at least one groove is a continuous groove in the coil-facing surface of the liner.

12. A condenser assembly according to claim 9 in which the liner is recessed on an upper surface thereof to retain liquid thereon, the liner further being apertured to receive a conduit through which moisture from an evaporator assembly is conveyed to the upper surface of the liner.

13. A condenser assembly according to claim 9 in which the liner has a peripheral horizontally-extending flange apertured to receive securing fasteners.

14. A condenser assembly according to claim 9 in which the liner has a horizontally-extending flange with respective entry and exit openings for the coolant coil.

15. A condenser assembly according to claim 9 in which the tray bottom has at least two horizontally extending flanges apertured to receive securing fasteners.

16. A condenser assembly of a refrigeration assembly comprising:

a condenser support having an opening formed therein;

a compressor supported by the condenser support;

a heat exchanging condenser supported by the condenser support and disposed adjacent to the compressor;

a condensate tray disposed at the opening of the condenser support and comprising, an operatively upper liner having a lower coil-facing surface, the liner being recessed on an upper surface thereof to retain liquid thereon, the liner being further apertured to receive a conduit through which moisture from an evaporator assembly is conveyed to the upper surface of the liner;

a continuous groove provided in the coil-facing surface of the liner;

an operatively lower tray bottom disposed below and spaced from the liner and having an upper coil-facing surface;

a coolant coil for carrying coolant from the compressor to the heat exchanging condenser, the coolant coil being located by the continuous groove in a predetermined path between the liner and the tray bottom;

the liner having a horizontally-extending flange with respective entry and exit openings for the coolant coil; and coupling means for securing the liner and the tray bottom to the condenser support.

17. A liner for use in a condensate tray of a condenser assembly comprising;

a lower coil-facing surface;

a single continuous groove provided in the lower coil-facing surface for locating a coolant coil in a predetermined path in the condenser assembly;

a peripheral horizontally-extending flange with respective entry and exit openings for the coolant coil;

a recessed upper surface for retaining liquid thereon; and an aperture for receiving a conduit through which moisture from an evaporator assembly is conveyed to the upper surface of the liner.

* * * * *